United States Patent [19]

Potts

[11] 4,365,501

[45] Dec. 28, 1982

[54] TOOL FOR CRIMPING CONNECTOR SLEEVES

[76] Inventor: Douglas L. Potts, 21 Flicker La., Rowayton, Conn. 06853

[21] Appl. No.: 299,651

[22] Filed: Sep. 8, 1981

[51] Int. Cl.[3] ..... B21D 37/10

[52] U.S. Cl. ..... 72/416; 29/517; 72/404; 72/472

[58] Field of Search ..... 72/416, 410, 412, 403, 72/404, 470, 472; 29/517

[56] References Cited

U.S. PATENT DOCUMENTS

| | | | |
|---|---|---|---|
| 402,045 | 4/1889 | Taylor | 72/404 |
| 519,817 | 5/1894 | Mette | 72/404 |
| 765,825 | 7/1904 | Felker | 72/404 |
| 2,247,928 | 7/1941 | Temple | 29/517 |
| 2,774,269 | 12/1956 | Demler | 72/472 |
| 3,101,766 | 8/1963 | Floyd | 72/412 |
| 4,043,174 | 8/1977 | Paolino | 72/472 |
| 4,118,971 | 10/1978 | Izraeli | 72/410 |
| 4,140,001 | 2/1979 | Moulton | 72/416 |

*Primary Examiner*—Gene Crosby

*Attorney, Agent, or Firm*—John K. Conant

[57] ABSTRACT

A tool for crimping a connector sleeve onto the ends of cable strands or the like for joining the strands together consists of an anvil arm having a V-shaped notch therein pivotally mounted relative to a base for its notch to be swung into cooperative opposed relation with a V-shaped notch in a die block on the base for crimping a connector sleeve that is placed through the die block notch.

The size of the crimp opening, defined by the two notches in cooperative opposed relation, is determined solely by the size of the notch in the die block. The notch in the anvil arm is the same for all crimp opening sizes. The die block has shoulder surfaces that are engaged by end portions of the walls of the anvil arm notch to bring the two notches into precise operative alignment and to stop relative movement of the notches together when they are in the spaced relation that will produce the size crimp desired.

A nose element on the base keeps the other strands of a multi strand cable out of the way so as not to be damaged by, or interefere with, the crimping of a connector sleeve onto one of the strands.

A number of die blocks, each having a different size notch, are provided and are adapted to be placed alternatively in operative position on the base for crimping connector sleeves of different diameters. The several die blocks are attached to the tool by a loop of flexible material that keeps the several alternative die blocks with the tool and that is also adapted to cooperate with guide slots in the tool to locate any selected one of the die blocks in operative position on the tool base. The loop also provides a handle for carrying the tool, as for hooking it onto a worker's tool belt.

10 Claims, 8 Drawing Figures

TOOL FOR CRIMPING CONNECTOR SLEEVES

BRIEF SUMMARY OF THE INVENTION

The present invention is a tool for crimping a connector sleeve onto a cable, strand or wire for joining sections of cables, wires or strands together.

Connector sleeves with which the tool as adapted to be used are short sleeves of deformable material, normally metal, into which the ends of cables, strands or wires that are to be joined are received. The sleeves are then crimped, i.e. permanently deformed or compressed, to grip the end portions of the cables, strands or wires therein.

The tool of this invention is particularly adapted for crimping electrically conductive connector sleeves onto the ends of electrical conductors for making good electrically conductive joints that are mechanically strong enough to resist being pulled apart by the tension to which the conductor may be subjected.

A problem with some types of crimping tools and methods is that the degree of crimping is dependent primarily upon the amount of pressure applied. If too little pressure is applied, the connection will be weak and easily pulled apart. If too much pressure is applied, the cable, strand or wire may be broken or weakened so that it could come apart under tension. Of course, if an electrical conductor is partially severed or severelydeformed, its electrical conductivity is also reduced. The tool of this invention, however, is adapted for making precisely dimensioned crimps so that even an unskilled worker will produce crimps that are uniformly strong without damaging the cable strands or wires being joined.

The preferred form of the tool of this invention also includes a number of different alternative die parts to enable the tool to be used to make a variety of different size crimps for different diameter connector sleeves.

Further, this tool is simple and rugged and is adapted to be made in a relatively small size (approximately one and one half by two by four inches, for example) without sacrificing the range of crimp sizes it is capable of making. The alternative die parts that may be provided are joined to the tool by a flexible loop which keeps the parts with the tool ready for alternative use therein. The loop also provides means for locating a selected one of the die parts in operative position, and is a handle for carrying the tool, or for hanging it on a worker's tool belt. Thus the tool is particularly useful for workers, such as mine workers and pole line workers, who need a suitable crimping tool readily available but who can not conveniently carry bulky or unwieldy tools with them.

A tool in accordance with this invention consists of an anvil arm, having a V-shaped notch in it, pivotally mounted relative to a base for its notch to be swung into opposed cooperative alignment with a V-shaped notch in a die block positioned on the base. A connector sleeve is crimped by bringing the two notches together under pressure around a connector sleeve that is laid through the notch in the die block.

The notch in the die block is formed between two projections thereon whose outer edges are guide shoulders that are engaged by the outer end portions of the anvil arm notch and guide the opposed notches together in correct operative alignment when the anvil arm is swung into engagement with the die block. Since the notch in the anvil arm is V-shaped, this construction of the notch in the die block enables the size of the crimp opening—the opening formed by the aligned opposed notches—which defines the size of the crimp to be made, to be made a different size by changing only the size of the notch in the die block. In other words the notch in the anvil arm is in effect a 'universal' notch in that it remains the same for different size crimp openings, the size of which is changed by replacing the die block with an alternative die block having a notch of a different size for crimping a different diameter connector sleeve. Several alternative die blocks, each with a different size notch, are preferably provided as associated parts of the tool.

Each die block is similarly constructed, except for the size of its notch, and the guide shoulders on each, in addition to guiding the die block notch and anvil arm notch into correct opposing alignment, also stop and position the notches precisely in predetermined spaced relation. Thus the dimensions, and hence the strength, of the crimp are determined solely by the dimensions defined by the size of the die block notch and even the most unskilled worker can not damage a cable strand, on which a connector sleeve is being crimped, by applying excessive pressure to the tool.

The several alternative die blocks that are preferably associated with the tools are attached to it by a loop of flexible material threaded through holes in the die blocks. The loop thus serves to keep the several die blocks together with the tool and provides a handle for carrying the tool, or for hooking it onto a worker's tool belt. Additionally the portions of the loop passing through the respective die blocks cooperate with slots at the sides of the tool to locate a selected one of the die blocks in operative position on the tool base.

BRIEF DESCRIPTION OF THE VIEWS OF THE DRAWINGS

Further objects, advantages and features of the crimping tool of this invention will be apparent from the following detailed description of a preferred embodiment of the invention shown in the accompanying drawings in which.

DETAILED DESCRIPTION

Figure 2:
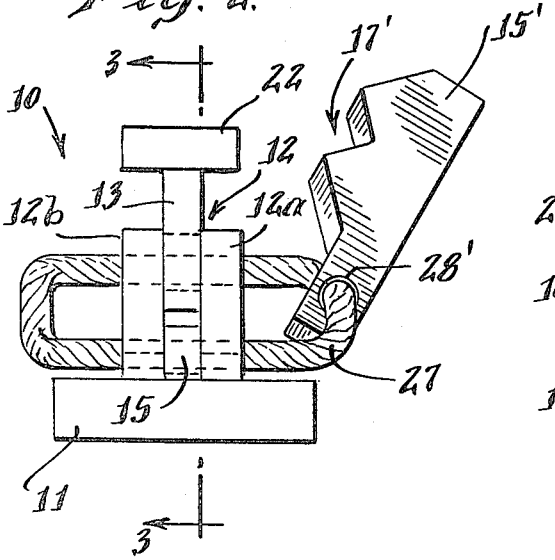
FIG. 2 is an end view of the tool shown in FIG. 1.
Figure 1:
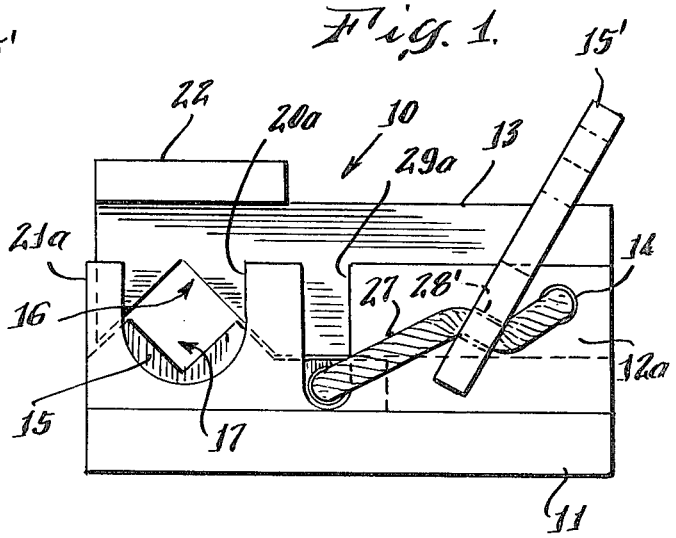
FIG. 1 is a side view of the tool, showing its operative parts in closed, crimping position.

Referring to FIGS. 1 and 2, the crimping tool 10 of this invention consists of a base 11 having a pair of parallel walls 12*a*, 12*b* thereon forming an elongated channel 12 in which an anvil arm 13 is pivotally mounted by a roll pin 14 fixed through the walls 12a, 12b and passing through a hole through the right end portion of the anvil arm. The anvil arm is thus pivotally mounted for its left lower edge to swing iinto and out of the channel, toward and away from a die block 15 that is removably received within the channel and supported on the base 11. The anvil arm 13 has a V-shaped notch 16 in its lower edge that comes into opposed relation with a V-shaped notch 17 in the upper edge of the die block 15 when the anvil arm is swung down into the channel.

Figure 4:
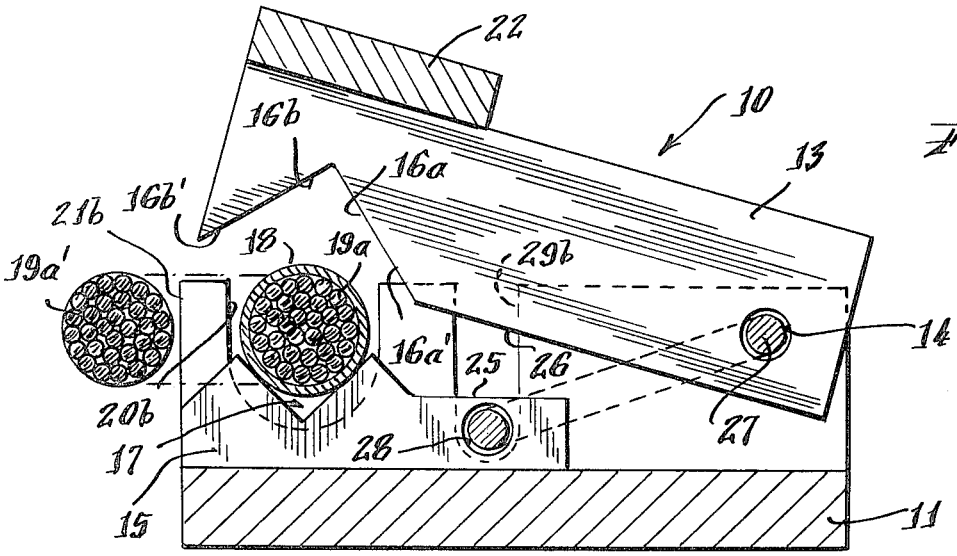
FIG. 4 is a partial view, similar to FIG. 3, but showing the operative parts in open position preparatory to a crimping operation.
Figure 7:
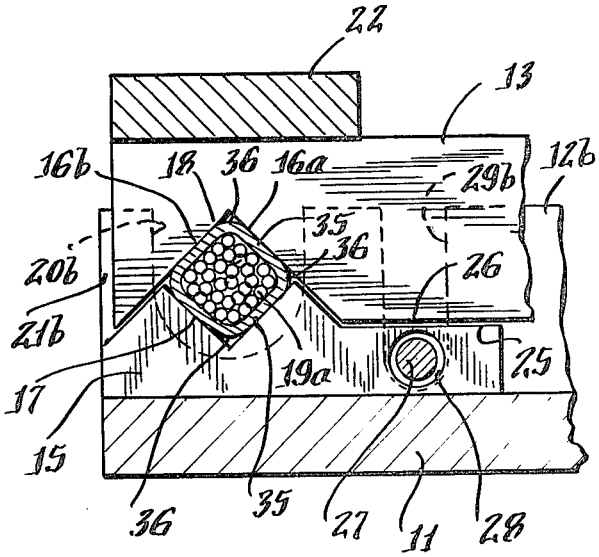
FIG. 7 is a partial view, similar to FIG. 3, showing in cross section the portion of the connector sleeve of FIG. 6 as crimped by the tool of FIG. 3.

As illustrated in FIG. 4 a tubular connector sleeve 18 is crimped onto a cable strand end portion 19a, that is inserted into the sleeve, by placing the connector sleeve 18 through the die block notch 17 and then swinging the anvil arm 13 down under pressure so that the sides of the notches 16 and 17 engage and deform the sides of the connector sleeve in to grip the strand portion 19a as shown in FIG. 7. The channel walls 12a, 12b have aligned slots 20a, 20b respectively therein extending down far enough at the location of the notch 17 in the die block 15 for a connector sleeve 18 to be laid through the die block notch 17 when the notched portion of the anvil arm is up out of the channel 12.

Referring again to FIG. 4 the tool 10 is adapted to keep separate the strands of a multi strand cable so that a connector sleeve 18 can be crimped onto one of the strands without damaging the other strands. For this purpose the slots 20a, 20b in the channel walls 12a, 12b are placed so as to leave slim nose portions 21a, 21b at the left end of the channel walls for the nose portions to extend upward alongside the die block notch 17. Thus when a cable strand end 19a in a connector sleeve 18 is placed for crimping in the die block notch 17, a second cable strand 19a' of the same cable is kept out of the path of movement of the anvil arm 13 by being placed outside the nose portions 21a, 21b.

The anvil arm 13 is suitably moved toward the die block 15 under sufficient pressure for their respective notches 16 and 17 to engage and crimp a connector sleeve 18 by placing the base 11 on a firm surface and delivering a hammer blow to a striking surface provided by a striker plate 22 on the upper edge of the anvil arm 13. The crimping pressure may of course be provided in other ways as by placing the tool 10 with the striker plate 22 and base 11 between the jaws of a vice and then closing the vice.

Figure 3:
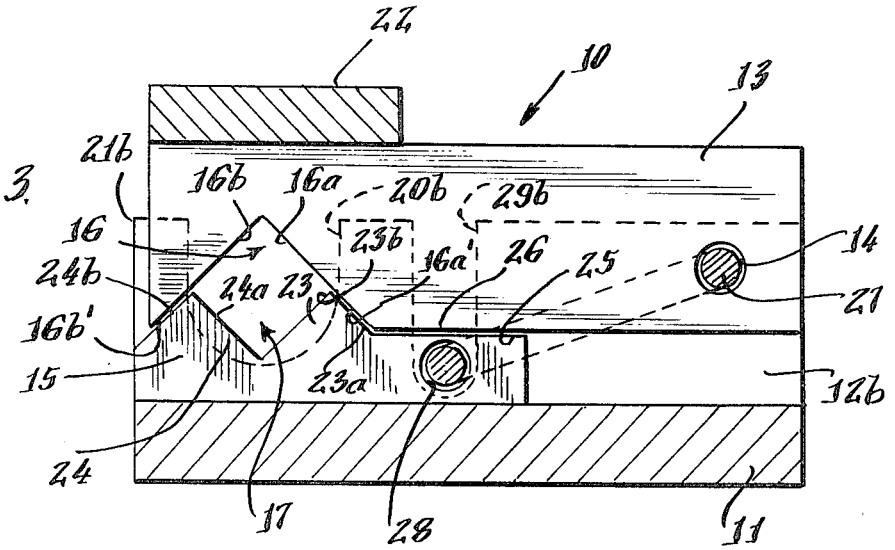
FIG. 3 is a section along the line 3—3 of FIG. 2.

As shown in FIGS. 1, 2 and 3 the die block 15 is received in the channel 12 and is held in lateral position therein by the channel walls. The notch 17 in the die block is formed by the adjacent edges, 23b and 24a, of a pair of V-shaped projections 23 and 24 from the upper edge of the die block, the projections being spaced to form the notch 17 between them.

The upper, open end of the die block notch 17, between the tips of the projections 23 and 24, is narrower than the open end of the notch 16 in the anvil arm. The relatively outward edges 23a and 24b of the projections 23 and 24 converge upward at substantially the same angle as the walls 16a, 16b of the anvil arm notch 16 diverge downward. Thus the edges 23a and 24b of the projections provide sloped guide shoulders that match the outer portions 16a', 16b' of the walls 16a, 16b of the anvil arm notch 16 and are engaged thereby when the anvil arm is swung down into the channel into engagement with the die block 15. In this way the outer edges 23a and 24b of the projections serve first to cooperate with the wall portion 16a', 16b' of the notch 16 to guide the notches 16 and 17 into correct operative alignment and then to locate and stop the notches 16 and 17 in precise operative spaced relation as the notch 16 wall portions 16a', 16b' seat on the sloped outer edges 23a, 24b of the die block projections. This stopping action of the sloped edges 23a, 23b is supplemented by an edge 25 at the bottom edge of the anvil arm coming to rest against an upper edge 26 of the die block, adjacent to the outer edge 23a of projection 23, when the notch 16 portions 16a', 16b' seat on the projection edges 23a, 24b. Thus the impact when the anvil arm is brought into engagement with the die block under pressure for a crimping operation is spread over a relatively large area of the cooperating tool parts so as to minimize the possibility of damage to the parts due to the impact and pressure applied .

Figure 5:
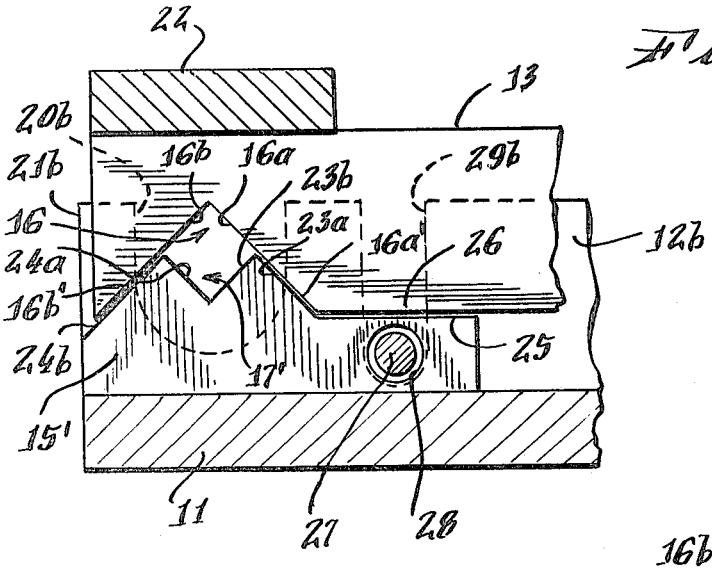
FIG. 5 is a partial view, similar to FIG. 3, but showing a die block of the tool having a different size notch than the comparable die block shown in the preceeding drawing Figures.

The tool 10 is adapted for making optimally effective crimps in various diameter connector sleeves by replacing the die block 15 in the tool with an alternative die block having a different size notch 17 that is compatible with the different diameter connector sleeve to be crimped. By reason of the construction of the notches 16 and 17 described above the size of the crimp opening formed by the cooperating notches 16 and 17, which defines the size of the crimp to be made, is determined solely by the size of the die block notch 17; the overall size of the anvil arm notch 16 remains the same. In practice several die blocks 15, each with a different size notch 17 compatible with connector sleeves of a particular diameter, are provided with the tool. Other than the size of the notch 17 the several die blocks provided all have the same overall dimensions and configuration so that each is adapted to be properly located for its notch 17 to be in correct operative alignment with the anvil arm notch 16 in the manner described above. This is illustrated by FIG. 5 which shows an alternative die block 15', that has a notch 17' smaller than the notch 17 of the die block 15, in operative position on the tool.

As illustrated by the die blocks 15 and 15' shown in FIGS. 1 and 2 the several alternative die blocks that are normally provided with the tool are strung on a closed loop 27 of flexible metal cable or the like and the loop iss attached to the tool to keep the die blocks readily available with the tool. As shown the loop 27 is suitably attached by passing through a bore through the roll pin 14 which is the pivot for the anvil arm. The loop 27 passes through holes 28, 28' through the respective die blocks 15, 15' so that the die blocks are freely movable along the loop. The channel walls 12a, 12b have slots 29a, 29b respectively therein in alignment and located to permit the portion of the loop 27 that passes through one of the die blocks, 15 or 15', to be received down in the channel walls when a selected one of the die blocks is to be placed in operative position within the channel. Additionally the slots 29a, 29b are located for the portion of the loop 27, through a die block being positioned in the channel and being received in the slots, to locate that die block in approximately correct longitudinal position in the channel for its notch 17 or 17' to be in approximate alignment with the anvil arm notch 16. When the die block in the channel is thus in approximately correct longitudinal alignment, the end portions 16a', 16b' of the anvil arm notch 16 will engage first the surface of a connector sleeve 18 in the notch 17 and then the edges 23a, 24b of the die block projections 23, 24 to bring the notches into precise alignment as the anvil arm seats on the die block.

BEST AVAILABLE COPY

As described the loop 27 serves to hold a number of alternative die blocks 15 conveniently available with the other tool parts and to assist in locating a selected one of the die blocks in operative position on the tool base. Additionally the loop provides a handle for carrying the tool and is particularly adapted for a worker to carry the tool with him by hooking it onto his tool belt.

In the preferred form of the invention shown in the drawings the notches 16 and 17 (and 17') respectively in the anvil arm 13 and die block 15 (and 15') are V-shaped notches with equal length sides meeting at 90°. Thus, regardless of the size of the die block notch 17 (or 17') relative to the size of the anvil arm notch 16, the crimp opening formed by the cooperating notches will be square. Of course, as previously described, the open end of the die block notch 17 (or 17') will always be narrower than the open end of the anvil arm notch 16 in order to provide the guide surfaces, 23*a*, 24*b* and 16*a'*, 16*b'*, which guide the notches into correct operative alignment and spacing.

The substantially square crimp opening thus formed in the preferred embodiment of the invention provides substantially optimal effective crimping of a connector sleeve 18 whose diameter is compatible with the size of the die block notch 17 (or 17'). As illustrated in FIG. 4 a die block selected for crimping a particular diameter connector sleeve 18 is one which has a notch 17 of a size such that its sides—edges 23*b* and 24*a* in FIG. 3—will each be shorter than the diameter of the connector sleeve 18 and the open end of the notch, between the tips of the projections 23 and 24, will slightly wider than the diameter of the connector sleeve. In other words, the sides of the crimp opening will each be shorter than the diameter of the connector sleeve and the diagonal of the crimp opening will be longer than the sleeve diameter. Also for effective crimping the connector sleeve selected should be one into hich the cable strand ends, illustrated by cable strand ends 19*a* and 19*b* in FIGS. 6 and 8, are received with a fairly close fit so that the crimps formed grip the strand ends firmly.

Figure 6:
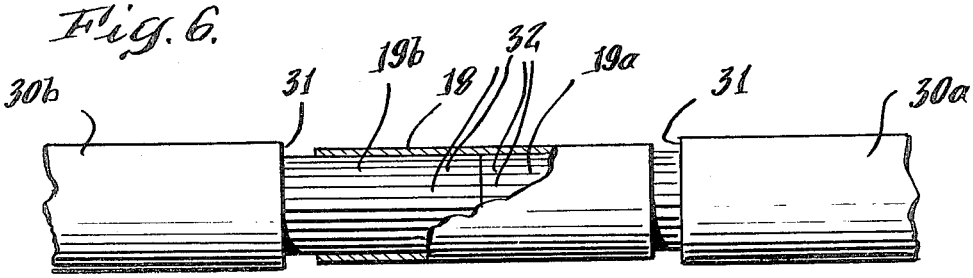
FIG. 6 is a side view, partly in section, showing two cable strand ends received within a connector sleeve ready for crimping of the sleeve thereon.
Figure 8:
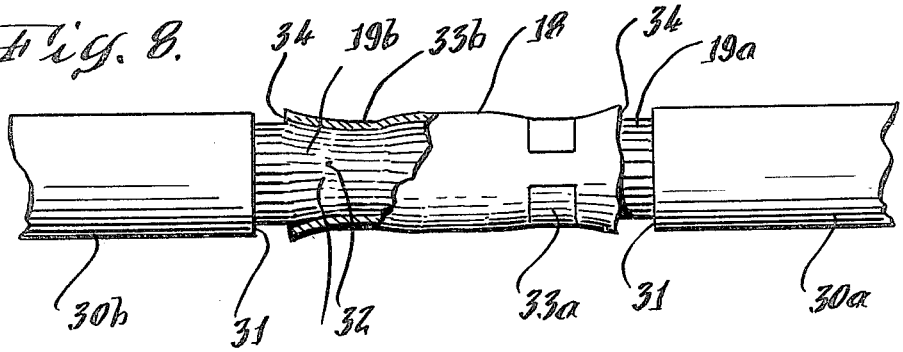
FIG. 8 is a view, similar to FIG. 6, but showing the connector sleeve after being crimped by the crimping operation illustrated in FIG. 7.

FIGS. 6,7 and 8 illustrate the manner in which the ends 19*a*, 19*b* of insulated electrical cable strands 30*a*, 30*b* are connected by a connector sleeve 18. The cable strands shown are covered by insulation 31 and the electrical conductor of each strand is composed of a bundle of fine wires 32. To make the connection the insulation 31 is stripped from the ends of the strands to bare the end portions 19*a*, 19*b* which are then inserted respectively into the opposite ends of the connector sleeve 18. The conductor ends 19*a*, 19*b* may be butted or overlapped inside the connector sleeve, which is made of electrically conductive material such as copper or aluminum, and the connection is completed by crimping in two places, indicated by crimps 33*a* and 33*b*, to crimp the sleeve onto each of the conductor ends.

The crimps 33*a* and 33*b* are made close enough to the ends of the connector sleeve 18, but spaced slightly in from the ends, so that the inward deformation of the sleeve material at the crimps causes the adjacent ends of the sleeve to flare outward forming bell shaped flares indicated at 34. These flared ends create a gradual stress transition from the highly compressed areas of the strands under the crimps 33*a*,33*b* to the relatively uncompressed portions of the strands outward from the ends of the connector sleeve. This stress transition eliminates stress concentrations that would otherwise be points of weakness at which the strands would tend to break under repeated flexing of the strands relative to the connector sleeve. Moreover the flared ends of the connector sleeve enable the strand ends to flex over a considerable angle relative to the ends of the sleeve without having to bend around a sharp edge which would bend and weaken the strands at those points.

FIG. 7 is a section through the tool and connector sleeve of FIG. 4, but showing the tool in crimping position, and showing in cross section the crimp 33*a* thus formed in the connector sleeve 18. As shown, by the crimp opening formed by right angle notches 16 and 17 the crimping force applies to the walls of the connector sleeve 18 from four different sides. Since the sides of the square crimp opening are each slightly shorter than the diameter of the connector sleeve 18 and since the diagonal of the square is slightly longer than the diameter of the connector sleeve, the cross sectional configuration of the crimp 33*a* thus produced is, as shown, eight sided, consisting of four flat sides 35 with four slightly curved sections 36 respectively between adjacent flat sides. The curved sections 36 are nearly as long as the flat sides 35 so that the cross sectional configuration of the crimp is close to circular. The benefit of this is that during and after the formation of the crimp the crimping pressure, and the resultant gripping pressure on the strand, is substantially equally distributed around the entire circuference of the strand so that a maximum gripping pressure is applied without weakening the strand or distorting it to any harmful extent.

A tool 10 in accordance with this invention is of simple, rugged and economical construction, it is conveniently portable and it is adapted for crimping a variety of different diameter connector sleeves by simple substitution of an alternative die block of which a number are connected to the tool for ready substitution therein. The tool produces uniformly precise crimps that are not dependent upon special operator skill for their precision, and it produces crimps that optimize gripping power without distorting and weakening the strands or wires onto which it crimps connector sleeves.

What is claimed is:

1. A tool for crimping a connector sleeve onto a cable strand or the like comprising:

a base, an anvil arm pivotally mounted relative to the base for a longitudinal edge thereof to swing toward and away from a portion of the base, a die block adapted to be removably supported on the base in position for a longitudinal edge thereof to be engaged by said edge of said anvil arm when the latter is swung toward said base, said anvil arm having a notch therein in said edge with at least the outward end portions of the walls of said notch being substantially flat and diverging outward to the mouth of said notch, said die block having a pair of projections spaced in line on said edge thereof with their adjacent edges forming a notch whose mouth is narrower than said mouth of the notch in said anvil arm edge, the edges of said pair of projections that are relatively outward thereof being shoulders that are substantially flat and converge outward relative to said die block at an angle substantially corresponding to the angle at which said wall portions of said notch in said anvil arm diverge, and said projections being dimensioned and located on said die block so that when said die block is in said position on said base and said anvil arm is swung for its said edge portion to swing toward said base, said flat end portions of said anvil arm notch engage and seat on said shoulders of said projections and thereby bring said two notches together into predetermined opposed alignment to form a crimp opening therebetween, whereby when a connector sleeve whose diameter is less than the width of the mouth of said die block notch but more than the length of the shortest diameter of said crimp opening is laid longitudinally through said notch in said die block before said anvil arm edge is swung toward said base and said anvil arm is thereafter swung so that said flat end portions of its notch seat on said projection shoulders, walls of said notches engage and compress sides of said connector sleeve.

2. The tool of claim 1 including wall means for locating said die block laterally in said position on said base.

3. The tool of claim 1 in which said notches are both V-shaped with the two sides of each notch being substantially the same length.

4. The tool of claim 1 in which said notches are both V-shaped with the sides of each notch being substantially 90° to each other.

5. The tool of claim 1 in which both said notches are V-shaped with the sides of each notch substantially 90° to each other and with the sides of each notch being substantially the same length, whereby said crimp opening formed by said notches is substantially square.

6. The tool of claim 1 including at least one nose element projecting from said base to be at a side of the end portion of said anvil arm that is outward of said anvil arm notch relative to the pivot point of said anvil arm when the anvil arm is in engagement with said die block that is in said position, said nose element being located and dimensioned to be outward of said crimp opening relative to said pivot point and for its edge that is outermost relative to said pivot point to be at least at the outermost edge of the path of movement of said anvil arm edge portion asdefined by movement of said anvil arm into engagement with said die block.

7. The tool of claim 1 including:

a plurality of said die blocks, said notches in different ones of said die blocks being different and each of said die blocks having a hole transversely therethrough, a flexible strand of material threaded through said holes through said die blocks for said die blocks to be moved relatively along said strand, and said strand being connected into a closed loop attached to said tool relative to said base, the length and location of said loop being sufficient to enable any selected one of said die blocks to be placed in said position on said base.

8. The tool of claim 7 including means for locating respective ones of said die blocks in said position on said base, comprising:

a pair of parallel walls projecting from said base and spaced apart approximately the width of each of said die blocks to receive any selected one of said die blocks between for locating said die block laterally in said position on said base, said walls each having a transverse slot therethrough opening through an edge of said wall, and said slots each being a width slightly greater than the diameter of said strand through said die blocks and being located and dimensioned for the portions of said strand at either side of a said hole through a said die block to be received in said slot when the latter die block is placed between said walls and for said slots to locate the latter die block longitudinally in said position on said base.

9. The tool of claim 7 including a pair of parallel walls projecting from said base and spaced apart to receive a said die block between them and to locate and hold said die block laterally in said position on said base, said anvil arm being pivotally mounted between said walls, each of said walls having a transverse slot therein opening through an edge of said wall, said slots being adjacent to said crimp opening and being located and dimensioned for a connector sleeve to pass longitudinally through said slots to be received longitudinally through said die block notch when said die block is in said position on said base and said anvil arm is out of engagement with said die block, each of said walls having a second transverse slot therethrough opening through an edge of said wall, and said second slots each being a width slightly greater than the diameter of said strand through said die blocks and being located and dimensioned for the portions of said strand at either side of a said hole through said die block to be received in said slot when the latter die block is placed between said walls and for said slots to locate the latter die block longitudinally in said position on said base.

10. The tool of claim 9 in which said loop is attached to said tool by said strand that forms said loop passing through said pivot of said anvil arm.

* * * * *